US006030517A

United States Patent [19]

Lincot et al.

[11] Patent Number: 6,030,517

[45] Date of Patent: Feb. 29, 2000

[54] PROCESS FOR PREPARING A FILM OF AN OXIDE OR A HYDROXIDE OF AN ELEMENT OF GROUPS IIB OR IIIA OF THE PERIODIC TABLE, AND THE COMPOSITE STRUCTURES WHICH INCLUDE SUCH A FILM

[75] Inventors: Daniel Lincot; Sophie Peulon, both of Vitry-Sur-Seine, France

[73] Assignee: Centre National de la Recherche Scientifique, Paris, France

[21] Appl. No.: 08/930,624

[22] PCT Filed: Apr. 2, 1996

[86] PCT No.: PCT/FR96/00495

§ 371 Date: Oct. 7, 1997

§ 102(e) Date: Oct. 7, 1997

[87] PCT Pub. No.: WO96/31638

PCT Pub. Date: Oct. 16, 1996

[30] Foreign Application Priority Data

Apr. 6, 1995 [FR] France ..... 95 04088

[51] Int. Cl.[7] ..... B65D 73/02; B65D 85/42

[52] U.S. Cl. ..... 205/333; 205/50; 205/124

[58] Field of Search ..... 205/333, 50, 316, 205/124, 155, 157, 320; 428/629; 438/95; 427/204, 205

[56] References Cited

U.S. PATENT DOCUMENTS

| | | | |
|---|---|---|---|
| 2,313,454 | 3/1943 | Stareck . | |
| 4,392,920 | 7/1983 | McDonald . | |
| 4,414,064 | 11/1983 | Stachurski et al. | 205/227 |
| 4,495,046 | 1/1985 | Switzer | 204/242 |
| 4,882,014 | 11/1989 | Coyle et al. . | |
| 5,352,300 | 10/1994 | Niwa | 136/256 |
| 5,486,238 | 1/1996 | Nakagawa et al. | 136/259 |
| 5,616,437 | 4/1997 | Gao | 429/245 |
| 5,804,466 | 9/1998 | Arao et al. | 438/95 |

OTHER PUBLICATIONS

Switzer, "Electrochemical Synthesis of Ceramic Films and Powders", *Am. Ceram. Soc. Bull.,* 66 [10] 1521–24 (1987). No month available.

*Primary Examiner*—Kathryn Gorgos
*Assistant Examiner*—Wesley A. Nicolas
*Attorney, Agent, or Firm*—Burns, Doane, Swecker & Mathis, LLP

[57] ABSTRACT

Process for depositing a film of a metal oxide or of a metal hydroxide on a substrate in an electrochemical cell, wherein (i) the metal hydroxide is of formula $M(OH)_xA_y$, M representing at least one metallic species in an oxidation state i chosen from the elements in Groups II and III of the Periodic Table, A being an anion whose number of charges is n, $0<x\leqq i$ and $x+ny=i$, (ii) the electrochemical cell comprises (a) an electrode comprising the substrate, (b) a counterelectrode, (c) a reference electrode and (d) an electrolyte comprising a conducting solution comprising at least one salt of the metal M, the process comprising the steps of:

dissolving oxygen in the electrolyte and imposing a cathode potential of less than the oxygen reduction potential and greater than the potential for deposition of the metal M in the electrolyte in question on the electrochemical cell.

28 Claims, No Drawings

PROCESS FOR PREPARING A FILM OF AN OXIDE OR A HYDROXIDE OF AN ELEMENT OF GROUPS IIB OR IIIA OF THE PERIODIC TABLE, AND THE COMPOSITE STRUCTURES WHICH INCLUDE SUCH A FILM

BACKGROUND OF THE INVENTION (i) Field of the Invention

The present invention relates to a process for preparing a film of a metal oxide or of a metal hydroxide of an element of Groups IIB or IIIA of the Periodic Table, deposited on a substrate.

(ii) Description of the Related Art

Metal oxides, in thin-film form, are very important materials in various technological fields because of their optical, electrical and catalytic properties. Among their many applications, mention may be made, for example, of the use of zinc oxide for the preparation of transparent conducting electrodes in solar cells.

The metal oxide thin films are generally obtained by vacuum deposition techniques, such as sputtering or chemical vapor deposition, or by deposition in successive layers using molecular beam epitaxy (MBE). All these processes involve expensive equipment.

Another process for preparing thin films of oxides is the reactive chemical spraying technique which is carried out in an ordinary atmosphere, without a closed chamber. However, the deposition temperatures are very high, of the order of 400–500° C.

Various studies have been undertaken in order to produce deposits electrolytically. For example, Jay A. Switzer, Electrochemical Synthesis of Ceramic Films and Powders, Am. Ceram. Soc. Bull. 66, [10] 1521–24 (1987), describes the preparation of an oxide film on the anode of an electrochemical cell by oxidation of a dissolved metal ion followed by hydrolysis and calcining, the process being illustrated by the preparation of thallium oxide. This process relies on increasing the oxidation state of the metal ion in solution, with the formation, and deposition on a substrate, of an insoluble oxide. However, this process can only be implemented in order to prepare the oxide of a metal which has at least two stable oxidation states in the reaction medium. J. A. Switzer (mentioned above) and R. T. Coyle, et al., (U.S. Pat. No. 4,882,014) furthermore describe the preparation of powders of metal oxides and hydroxides as ceramic precursors. These powders are formed by precipitation near the cathode of an electrochemical cell, this precipitation being caused by the reduction of nitrate ions. Next, these powders are dried and sintered at high temperature in order to obtain the ceramic materials. The deposits possibly formed on the cathode are scraped off and recovered in powder form. The intended objective is consequently the formation of a powder, and neither the direct formation of an oxide or hydroxide film on a substrate, nor its use as such are described. Furthermore, no mention is made of an oxygen reduction reaction for the formation of an oxide or hydroxide film.

SUMMARY AND OBJECTS OF THE INVENTION

The object of the present invention is to provide a process which does not have the drawbacks of the processes of the prior art, in order to obtain a film of a metal oxide or of a metal hydroxide on a substrate by an electrochemical route, said film exhibiting good mechanical integrity and good adhesion to the substrate.

The subject of the present invention is a process for depositing a film of a metal oxide or of a metal hydroxide of formula $M(OH)_xA_y$, M representing at least one metallic species in the oxidation state i chosen from the elements in Groups IIB and IIIA of the Periodic Table, A being an anion whose number of charges is n, $0<x\leqq i$ and $x+ny=1$, on a substrate in an electrochemical cell which includes an electrode consisting of said substrate, a counterelectrode, a reference electrode and an electrolyte consisting of a conducting solution of at least one salt of the metal M. The process is characterized in that oxygen is dissolved in the electrolyte and a cathode potential of less than the oxygen reduction potential and greater than the potential for deposition of the metal M in the electrolyte in question is imposed on the electrochemical cell.

When a potential as defined above is imposed on the electrochemical cell, this causes reduction of the oxygen and the formation of an oxide or hydroxide $M(OH)_xA_y$ of the metal M which is deposited on the cathode.

DETAILED DESCRIPTION OF THE PREFERRED EMBODIMENTS

In the rest of the text, the expression "compound of M" is used to denote indiscriminately the pure metal oxide, the hydroxide $M(OH)_i$ or the complex hydroxide $M(OH)_xA_y$.

The process of the present invention can be implemented in order to prepare a film of a compound of a single metal. It can also be implemented in order to prepare a film of a mixed compound containing at least two metallic elements. When preparing a film of a mixed compound, at least one precursor salt of each of the desired metallic species is introduced into the electrolyte and the potential imposed on the electrochemical cell is greater than the potential for metallic deposition in the bath in question.

The process of the present invention can be implemented for preparing a film of a compound of at least one metal M chosen from the metallic elements in Groups IIB and IIIA of the Periodic Table, and more especially for preparing a film of a zinc, cadmium, gallium or indium compound.

The electrochemical cell used for implementing the process of the invention includes an electrode, which operates as the cathode and which serves as the substrate for the film of the electrodeplated compound of M, a counterelectrode and a reference electrode.

The electrode consists of any conductive material which can be used as a cathode material. By way of example, mention may be made of metallic materials such as, for example, iron, steels, copper or gold, of conductive metal oxides such as, for example, tin oxide $SnO_2$, indium oxide $In_2O_3$, mixed indium tin oxide (ITO) or titanium oxide $TiO_2$, or of semiconductor materials such as silicon, GaAs, InP, $Cu(In,Ga)(S,Se)_2$ or CdTe. These materials can be used in sheet form or in the form of a thin film deposited on an insulating substrate such as, for example, glass.

The counterelectrode may be an incorrodible electrode such as, for example, a platinum or gold electrode, or a material coated with these metals. It may also be an electrode consisting of the metal M of the compound of which it is desired to form a film. In this case, the oxidation of the metal M of the counter-electrode makes it possible to keep the concentration of metal M in the electrolyte constant.

The reference electrode is chosen from the electrodes normally used as such, in particular the mercurous sulfate electrode (MSE) or the standard calomel electrode (SCE) . The corresponding potentials are respectively +0.65 V and +0.25 V with respect to the standard hydrogen electrode (SHE).

The electrolyte contains at least one precursor salt of at least one metallic species M and a solvent.

The solvent of the electrolyte is chosen from water and the nonaqueous polar solvents normally used in electrochemical cells, among which may be mentioned alcohols, more particularly isopropanol, acetonitrile, dimethylsulfoxide and propylene carbonate. Water is a particularly preferred solvent.

The precursor salt of the metallic element M may be chosen from the salts which are soluble in the solvent used for the electrolyte. Among these salts, mention may be made of inorganic salts, such as halides, sulfates, nitrates and perchlorates, and organic salts, such as acetates.

The electrolyte may optionally contain at least one second salt, called a supporting salt. This second salt is a salt which can dissociate in the solvent used and its main function is to ensure that the electrolyte has a good electrical conductivity, especially if the concentration of the precursor salt of the metal M is low. This salt may be chosen from sodium, potassium and ammonium salts, the anion of which will not cause precipitation of an insoluble compound with the metal cation M. By way of example, mention may be made of inorganic salts such as halides, sulfates, nitrates and perchlorates, and organic salts such as acetates, lactates and formates. In order to deposit a film of a zinc compound, this second salt is advantageously potassium chloride, preferably having a concentration of approximately 0.1 mol/l.

The electrolyte may also contain, in addition to or in place of the second salt, a compound which complexes with the cation M, in order to match the conditions for forming the compound of M to the window allowed by the reduction of oxygen. For example, in the case of gallium compounds or indium compounds, the addition of complexing agents, chosen, for example, from oxalates, citrates, fluorides, chlorides, iodides and bromides, makes it possible to dissolve the precursor salt of the metal in slightly acid medium (pH≈5–4).

The electrolysis is carried out in the presence of oxygen dissolved in the electrolyte. The concentration of oxygen is fixed between very low values, of the order of $10^{-5}$ mol/l, and the solubility limit of oxygen in the electrolyte (of the order of $10^{-3}$ mol/l in aqueous medium). Advantageously, the oxygen can be dissolved by introducing, into the electrolyte, a gas mixture consisting of oxygen and an inert gas. The inert gas may be argon or nitrogen. A suitable choice of the oxygen concentration in the gas mixture and of the gas flow rate into the electrolyte makes it possible to impose a predetermined oxygen concentration in the electrolyte. Preferably, the oxygen/inert gas volume ratio is between 1 and 2.

When implementing the process of the invention, the potential imposed on the electrochemical cell is kept constant at a predetermined value between the potential for deposition of the metal M in the electrolyte in question and the oxygen reduction potential. The potential for deposition of the metal M in the electrolyte in question can be easily determined by those skilled in the art by measuring the current as a function of the potential in an electrochemical cell similar to that in which the process of the invention is implemented, in the absence of oxygen. The oxygen reduction potential is found in the literature. By way of example, the potential for deposition of a film of zinc oxide on an SnO2 [sic] cathode may be fixed between −0.75 V and −0.1 v [sic] with respect to SHE and for deposition of a film of cadmium hydroxide on a gold cathode between −0.24 V and −0.05 V with respect to SHE.

Implementing the process according to the invention generally produces a linear increase in the thickness of the deposit as a function of time. The thickness of a film may consequently be predetermined by adjusting the amount of electricity used for the deposition. Thicknesses of a few nm to a few μm may be obtained. The deposition rate which is particularly favorable lies between approximately 0.5 and 1 μm/h.

The nature of the compound, of which the film deposited on the electrode of the electrochemical cell is composed, may be chosen by fixing the reaction conditions appropriately.

In order to obtain an oxide film, it is expedient to implement the process of the invention under conditions in which the oxide is thermodynamically more stable than the hydroxide. In this case, in aqueous medium, favorable conditions are obtained with relatively low deposition rates and high temperatures. As a result, in order to obtain oxides from aqueous solutions, low M(i) concentrations will be used. For example, in order to obtain a film of zinc oxide from a solution containing KCl as the supporting salt, a Zn(II) concentration of preferably less than $10^{-2}$ mol/l, more particularly of less than $5\times10^{-3}$ mol/l, a temperature at least equal to 50° C. and an oxygen concentration of less than the saturation concentration in the solution are used.

In order to obtain a hydroxide deposit in aqueous medium, it is expedient to implement the process of the invention at a relatively high deposition rate and at a relatively low temperature. These conditions are fulfilled when high M(i) concentrations are used. For example, in order to obtain a film of the compound $Zn(OH)_xA_y$, a Zn(II) concentration of greater than $2\times10^{-2}$ mol/l, a temperature of less than 50° C. and an oxygen concentration less than or equal to the saturation concentration are used.

In nonaqueous medium, the process of the invention leads to the deposition of oxide films.

In an $M(OH)_xA_y$ film, the anion A is the anion introduced into the electrolyte by the precursor salt of the metal M, or else the anion of the second, dissociable salt introduced into the electrolyte in order to increase its conductivity. The anion A is chosen depending on its propensity to form defined compounds with the metal M and with the hydroxyl ions and depending on the expected properties of the film deposited. Thus, it may be advantageous to obtain halide-doped zinc oxide films.

The films obtained using the process of the invention are highly adherent to the substrate, this constituting a fundamental criterion for the applications. Depending on the deposition conditions, their structure may vary from a very open structure caused by the growth of mutually separate crystals, the crystalline quality of which is, all the same, remarkable, to a dense structure caused by coalesced grains. One particular type of structure can be obtained by appropriate choice of the density of substrate nucleation sites parameter and of the electrolysis potential parameter. The lower the density of nucleation sites, the more open the structure will be. Conversely, the higher the density of nucleation sites, the more dense the structure will be. Furthermore, the more negative the potential, the more dense the structure will be. It should also be noted that prior electrochemical treatment of the substrate, in the absence of metal ions, for example by reduction of oxygen, enables more dense deposits to be obtained. Another process for activating the substrate consists in depositing a very thin sublayer of metal M, with a thickness of about a few nanometers, by applying a more cathodic potential for a very short time (for example, about 30 seconds) before applying the potential for deposition of the compound of M.

The process of the present invention makes it possible to obtain a multilayer structure, consisting of a conductive substrate layer and a film of oxide or of hydroxide $M(OH)_x A_y$, which constitutes another subject of the present invention. Depending on the nature of the conductive substrate layer and of the film, the composite structure has various applications.

Multilayer structures which include a dense film are generally useful for applications requiring continuous layers. Such structures can be used, for example, as a chemical or electrochemical sensor or as a catalyst. The composite structures may also be used as a transparent electrode in solar cells, in flat luminescent devices and, more generally, in various optoelectronic devices. In one particular embodiment, the substrate layer consists of a thin layer of a material chosen from iron, steels, copper, gold, conductive metal oxides, such as, for example, tin oxide $SnO_2$, indium oxide $In_2O_3$, mixed indium tin oxide (ITO) or titanium oxide $TiO_2$, and semiconductor materials, such as silicon, GaAs, InP, $Cu(In,Ga)(S,Se)_2$ or CdTe. In a preferred embodiment, the substrate layer consists of a thin layer of one of the previous materials, deposited on a sheet of glass.

Multilayer structures which include an open-structure film are used for applications requiring highly developed surfaces. By way of example of such applications, mention may be made of chemical or electrochemical sensors, and catalysts.

The present invention is described below in more detail by specific examples of implementation of the process of the invention, these being given by way of illustration, the invention, of course, not being limited to these examples.

EXAMPLE 1

PREPARATION OF A ZINC OXIDE FILM

The device used includes an electrolysis tank, an electrode, a counterelectrode and a reference electrode, all three being connected to a potentiostat. The electrolysis tank is fitted with a stirring system and with means for introducing, with a predetermined flow rate, an argon/oxygen gas mixture having a predetermined composition. The temperature is held constant at 80° C. using a water bath.

The electrode consists of an $SnO_2$ film deposited on glass. The counterelectrode consists of a sheet of platinum. The reference electrode is a mercurous sulfate electrode.

Prior to implementing the process, the $SnO_2$ electrode was subjected to a treatment which consists in holding it for 20 minutes at a potential of −1.3 V/MSE lying within the oxygen reduction region, in a KCl solution (0.1 mol/l) not containing the metallic element the oxide of which it is desired to deposit, in the presence of oxygen dissolved to saturation.

An electrolyte consisting of an aqueous KCl solution (0.1M) and zinc chloride ($5\times10^{-3}$M) are introduced into the electrolysis tank fitted with the electrode thus treated. Next, an oxygen/argon gas mixture (oxygen/argon volume ratio= 1.4) is bubbled through the electrolyte for one hour so that the solution is indeed in equilibrium with the gas mixture. After equilibrium has been achieved, the gas mixture continues to be bubbled into the electrolyte and at [sic] a potential of −1.3 V with respect to the reference electrode (corresponding to a potential of −0.65 V/SHE) is applied to the cell. The reaction is stopped after 1 h 30 min and the film obtained has a thickness of 1 $\mu$m, the thickness being determined using a mechanical profilometer. This thickness is related to the amount of electricity consumed during the deposition (≈7 C for 5 $cm^2$).

The oxide film obtained was characterized using various methods.

X-ray analysis

The X-ray diffraction pattern of the zinc oxide film obtained, oriented preferentially along the <002> axis, shows only the lines characteristic of the hexagonal phase of zinc oxide (20.1°) and the lines corresponding to the substrate.

Analysis by electron spectroscopy (EDS)

This analysis was carried out by measuring the X-rays emitted under electron bombardment in a scanning microscope. The energies are characteristics of the atoms. In the EDS spectrum of the film obtained, the absence of a peak at 2.830 keV is noted, which makes it possible to conclude that no chloride ions are present in the product obtained and confirms that the product obtained is the oxide and not a complex hydroxide.

Infrared analysis

The infrared spectrum of the zinc oxide film obtained exhibits the band lying around 450–550 $cm^{-1}$, this being characteristic of ZnO. No band characteristic of hydroxyl ions is visible.

The structure of the film

The film obtained is dense, transparent, smooth and homogeneous. On the curve of direct optical transmission of the zinc oxide film obtained, for wavelengths in the visible range (>400 nm), the transmission is high, in agreement with the transparency of the film to the naked eye. Toward the short wavelengths there appears an abrupt absorption edge, which indicates the semiconducting nature of the film and the presence of a band gap at approximately 3.4 eV, corresponding to that of ZnO.

Capacitance measurements, carried out in an electrolytic medium, have shown that the ZnO film obtained was an n-type conductor [sic] and that the apparent doping level is high, about $10^{18}$–$10^{19}$ $cm^{-3}$.

EXAMPLE 2

PREPARATION OF A ZINC OXIDE FILM HAVING AN OPEN STRUCTURE

The process of the invention was implemented under conditions similar to those in Example 1, but by omitting the prior treatment of the $SnO_2$ electrode, the latter simply being degreased.

Under these conditions, the oxide deposit obtained consists of a multitude of needles of hexagonal cross section, the bases of which are attached to the substrate. These needles are well separated from each other and consequently constitute an open structure exhibiting a highly developed surface. The length of the needles may reach several $\mu$m for a base surface area of about 1 $\mu m^2$. It increases with the deposition time.

EXAMPLE 3

PREPARATION OF A $Zn(OH)_xCl_{1-x}$ FILM

The device used is similar to that used for the preparation of an oxide film and the operating conditions are identical, save from that relating to the composition of the electrolyte. The electrolyte is an aqueous solution of KCl (0.1M) and of zinc chloride ($3\times10^{-2}$M).

The film obtained has a thickness of 0.5 $\mu$m, determined using a mechanical profilometer. This thickness is related to the amount of electricity consumed during the deposition.

The hydroxide film obtained was characterized using various methods.

X-ray analysis

The X-ray diffraction pattern of the hydroxide film shows a preferred orientation along the 6.5° line of the compound $Zn_5(OH)_8Cl_2$.

Analysis by electron spectroscopy (EDS)

This analysis was carried out as previously. It shows the presence of a peak at 2.83 keV, characteristic of chloride ions.

Infrared analysis

The infrared spectrum of the zinc hydroxide film obtained exhibits a strong band lying around 3500 $cm^{-1}$, this being characteristic of hydroxyl ions. The band characteristic of Zn—O bonds in the oxide around 500 $cm^{-1}$ is not present.

Structure of the film

The film obtained is a covering film and consists of well-defined hexagonal grains.

EXAMPLE 4

PREPARATION OF A CADMIUM HYDROXIDE FILM

The device used is similar to that used for the preparation of a zinc oxide film and the operating conditions are identical, save with regard to the following points:

- the potential applied to the cathode is −0.9 V/ref. (−0.3 V/SHE);
- the electrolyte is an aqueous solution containing $NaClO_4$ (0.1M) and $CdCl_2$ ($5\times10^{-4}$M), saturated with oxygen, at a temperature of 80° C.;
- the reaction time is one hour.

The film obtained has a thickness of 0.3 $\mu$m, determined by electron microscopy.

The hydroxide film obtained was characterized using various methods.

X-ray analysis

The presence of the line characteristic of $Cd(OH)_2$ is observed in the X-ray diffraction pattern.

Analysis by electron spectroscopy

This analysis was carried out as previously. The absence of lines characteristic of chlorine is noted.

Structure of the film

The film obtained has an open structure.

EXAMPLE 5

PREPARATION OF A $Cd(OH)_xCl_{1-x}$ FILM

The device used is similar to that used for the preparation of a zinc oxide film and the operating conditions are identical, save as regards the following points:

- the potential applied to the tank is −0.15 V/SHE;
- the electrolyte is an aqueous solution containing KCl (0.1 mol/l) and $CdCl_2$ ($10^{-2}$ mol/l), saturated with oxygen, at a temperature of 50° C.

The film obtained has a thickness of 0.4 $\mu$m, determined by electron microscopy.

The complex hydroxide film obtained has a covering structure.

The $Cd(OH)_xCl_{1-x}$ composition was confirmed by X-ray analysis and by electron spectroscopy analysis.

EXAMPLE 6

PREPARATION OF A FILM OF A GALLIUM COMPOUND

The device used is similar to that used for the preparation of a zinc oxide film and the operating conditions are identical, save as regards the following points:

- the potential applied to the tank is −0.65 V/SHE;
- the electrolyte is an aqueous solution with a pH of 3, containing potassium chloride (0.1 mol/l), gallium sulfate ($7.7\times10^{-3}$ mol/l) and sodium oxalate ($6\times10^{-3}$ mol/l), saturated with oxygen, at a temperature of 50° C.

The film obtained after one hour has a thickness of 0.5 $\mu$m, determined by electron microscopy. It is transparent and covering.

The X-ray analysis shows the predominant presence of gallium and oxygen. The Ga/O stoichiometric ratio, determined using a $Ga_2O_3$ standard, is 0.324. The gallium compound obtained consequently corresponds to gallium hydroxide $Ga(OH)_3$ or to the hydrated gallium oxide $Ga_2O_3.3H_2O$.

We claim:

1. Process for depositing a film of a metal oxide or of a metal hydroxide on a substrate in an electrochemical cell, wherein (i) said metal oxide comprises a cation M and said metal hydroxide is of formula $M(OH)_xA_y$, M representing at least one metallic species in an oxidation state i selected from the group consisting of the elements in Groups IIB and IIIA of the Periodic Table, A being an anion whose number of charges is n, said formula satisfies $$0<x\leq i \text{ and } x+ny=i,$$

(ii) said electrochemical cell comprises (a) an electrode comprising said substrate, (b) a counterelectrode, (c) a reference electrode and (d) an electrolyte comprising a conducting solution comprising at least one salt of the metal M, said process comprising the steps of:

dissolving oxygen in the electrolyte and imposing a cathode potential of less than the oxygen reduction potential and greater than the potential for deposition of the metal M in the electrolyte in question on the electrochemical cell, whereby the oxidation state of said metal M in said metal salt is the same as the oxidation state of said metal M in said metal oxide or metal hydroxide.

2. Process according to claim 1, wherein M is Zn, Cd, Ga or In.

3. Process according to claim 1, wherein said electrolyte comprises a polar solvent.

4. Process according to claim 3, wherein said polar solvent is water.

5. Process according to claim 1, wherein the salt of the metal M is a halide, a sulfate, a nitrate, a perchlorate, or an acetate.

6. Process according to claim 1, wherein the oxygen dissolved in the electrolyte is supplied by a mixture of inert gas and oxygen.

7. Process according to claim 1, wherein the counterelectrode is an electrode comprising the metal M.

8. Process according to claim 1, wherein the electrolyte comprises at least one dissociable supporting salt chosen from organic and inorganic salts comprising an anion which will not cause precipitation of an insoluble compound with the metal cation M.

9. Process according to claim 8, wherein the supporting salt is a halide, sulfate, nitrate, perchlorate, acetate, lactate, formate, oxalate, or citrate.

10. Process according to claim 8, wherein said organic or inorganic salt is a sodium, potassium or ammonium salt.

11. Process according to claim 1, for the preparation of an oxide film, wherein said electrolyte comprises an aqueous medium comprising KCl and wherein said metal M is Zn(II), in which the Zn(III) is present at a concentration of less than $10^{-2}$ mol/l, the medium has a temperature of at least 50° C. and the oxygen is present at a concentration less than saturation concentration in the solution.

12. Process according to claim 11, wherein the Zn(II) concentration is less than $5\times10^{-3}$ mol/l.

13. Process according to claim 1, for the preparation of a $Zn(OH)_xA_y$ film, wherein said electrolyte comprises an aqueous medium comprising KCl and has a concentration of Zn(II) greater than $2\times10^{-2}$ mol/l, a temperature less than 50° C. and an oxygen concentration less than or equal to saturation concentration.

14. Process according to claim 1, wherein the electrolyte comprises at least one precursor salt of different metallic species M.

15. Process according to claim 1, wherein the electrode comprises a metallic material, a conductive metal oxide, or a semiconductor material.

16. Process according to claim 15, wherein the metallic material or the semiconductor material is a thin film deposited on an insulating substrate.

17. Process according to claim 16, wherein the insulating substrate is transparent.

18. Process according to claim 15, wherein said metallic material is iron, steel, copper or gold.

19. Process according to claim 15, wherein said conductive metal oxide is tin oxide $SnO_2$, indium oxide $In_2O_3$, mixed indium tin oxide (ITO) or titanium oxide $TiO_2$.

20. Process according to claim 15, wherein said semiconductor material is silicon, GaAs, InP, Cu(In,Ga) $(S,Se)_2$ or CdTe.

21. Process according to claim 1, wherein the electrolyte comprises at least two metal salts, M representing more than one metallic species.

22. Process according to claim 1, wherein said electrolyte further comprises in addition to or in place of the second salt, a compound which complexes with the cation M.

23. Process according to claim 22, wherein said compound is a gallium compound or an indium compound and the complexing agent is an oxalate, citrate, fluoride, chloride, bromide, or iodide.

24. Multilayer structure comprising a substrate layer supporting a film of a metal hydroxide of formula $M(OH)_xA_y$, M representing at least one metallic species in an oxidation state i selected from the group consisting of the elements in Groups IIB and IIIA of the Periodic Table, A being an anion whose number of charges is n, said formula satisfies $0<x\leqq i$ and $x+ny=i$, the substrate layer being a layer of a conductive material selected from the group consisting of iron, steel, copper, gold, a coductive metal oxide and a semiconductor material.

25. Multilayer structure according to claim 24, wherein the layer of conductive material or of semiconductor material is supported by an insulating plate.

26. Multilayer structure according to claim 24, wherein the conductive metal oxide is tin oxide $SnO_2$, indium oxide $In_2O_3$, mixed indium tin oxide (ITO) or titanium oxide $TiO_2$.

27. Multilayer structure according to claim 24, wherein the semiconductor material is silicon, GaAs, InP, Cu(In, Ga) $(S,Se)_2$ or CdTe.

28. Electrode for a photocell, comprising a multilayer structure according to claim 24.

* * * * *